US011852005B2

(12) United States Patent
San Roman Alerigi et al.

(10) Patent No.: US 11,852,005 B2
(45) Date of Patent: Dec. 26, 2023

(54) DEFORMATION MONITORING MECHANISM WITH MULTI-PIXEL ANGLE-SENSITIVE LASER RANGING

(71) Applicant: SAUDI ARABIAN OIL COMPANY, Dhahran (SA)

(72) Inventors: Damian Pablo San Roman Alerigi, Al Khobar (SA); Adrian Cesar Cavazos Sepulveda, Nuevo Leon (MX); Sameeh Issa Batarseh, Dhahran (SA); Jose Oliverio Alvarez, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 78 days.

(21) Appl. No.: 17/643,487

(22) Filed: Dec. 9, 2021

(65) Prior Publication Data

US 2023/0184086 A1 Jun. 15, 2023

(51) Int. Cl.
*E21B 47/002* (2012.01)
*E21B 47/007* (2012.01)
(Continued)

(52) U.S. Cl.
CPC ..... *E21B 47/002* (2020.05); *E21B 47/007* (2020.05); *E21B 47/01* (2013.01); *E21B 47/12* (2013.01)

(58) Field of Classification Search
CPC ..... E21B 47/002; E21B 47/007; E21B 47/01; E21B 47/12
See application file for complete search history.

(56) References Cited

U.S. PATENT DOCUMENTS 4,328,704 A 5/1982 Arpasi et al.
5,517,854 A * 5/1996 Plumb ..... E21B 49/008 73/152.59
(Continued)

FOREIGN PATENT DOCUMENTS

CN 101397903 B 8/2012
CN 214366031 U 10/2021

OTHER PUBLICATIONS

Wang, Albert, et al., "Angle Sensitive Pixels in CMOS for Lensless 3D Imaging", IEEE Custom Integrated Circuits Conference (CICC), pp. 371-374, 2009 (4 pages).
(Continued)

*Primary Examiner* — Jonathan Malikasim
(74) *Attorney, Agent, or Firm* — Osha Bergman Watanabe & Burton LLP

(57) ABSTRACT

A monitoring device monitors deformation of a casing installed in a wellbore and housing a production tubing, and includes: a packer installed within an annulus between the casing and the production tubing; a deformable substrate that is disposed at an outer side of the annulus and contacts an inner surface of the casing to deform along with casing deformation; a light source that is disposed on the deformable substrate and emits light towards an inside of the annulus; an imaging device that is disposed in the packer to be opposite to the light source across the annulus and detects the light emitted from the light source; and a processor that produces a signal from the detected light, processes the produced signal, and transmits the processed signal to a surface control device that monitors the deformation of the casing based on the signal.

19 Claims, 7 Drawing Sheets

(51) Int. Cl.
*E21B 47/01* (2012.01)
*E21B 47/12* (2012.01)

(56) References Cited

U.S. PATENT DOCUMENTS

| | | | | |
|---|---|---|---|---|
| 6,931,149 | B2 | 8/2005 | Hagene et al. | |
| 7,832,477 | B2 | 11/2010 | Cavender et al. | |
| 7,950,456 | B2 | 5/2011 | Cavender et al. | |
| 8,973,434 | B2 | 3/2015 | Albrecht et al. | |
| 9,075,155 | B2 | 7/2015 | Luscombe et al. | |
| 9,574,434 | B2 | 2/2017 | Albrecht et al. | |
| 10,036,247 | B2 | 7/2018 | Moronkeji et al. | |
| 10,877,192 | B2 * | 12/2020 | Bovero | B29D 11/00769 |
| 11,193,896 | B2 * | 12/2021 | Stewart | H04N 7/181 |
| 11,619,097 | B2 * | 4/2023 | Batarseh | E21B 7/14 175/16 |
| 2009/0166040 | A1 | 7/2009 | Cavender et al. | |
| 2011/0066380 | A1 * | 3/2011 | Hager | E21B 43/16 702/12 |
| 2012/0312560 | A1 * | 12/2012 | Bahr | E21B 33/1208 166/387 |
| 2013/0034324 | A1 | 2/2013 | Laing et al. | |
| 2014/0360613 | A1 | 12/2014 | Abshire et al. | |
| 2021/0262343 | A1 | 8/2021 | Dupont et al. | |
| 2022/0316331 | A1 * | 10/2022 | Cavazos Sepulveda | E21B 49/0875 |
| 2022/0372868 | A1 * | 11/2022 | Alerigi | G01M 5/0091 |

OTHER PUBLICATIONS

Hadi, Fatemeh, et al., "Assessment of Performance of Tesla Turbine in Water Distribution Systems for Energy Harvesting", Journal of Energy Resources Technology, vol. 143, 2021 (8 pages).
Mao, Huina, et al., "Twist, tile and stretch: From isometric Kelvin cells to anisotropic cellular materials", Materials and Design 193, pp. 1-15, 2020 (15 pages).
Ming, Zunzhen, et al., "Switching between Elasticity and Plasticity by Network Strength Competition", Advanced Materials, 2020 (8 pages).
Tohidi, Shafagh D., et al., "Microstructural-mechanical properties relationship in single polymer laminate composites based on polyamide 6", Composites Part B 153, pp. 315-324, 2018 (10 pages).
Zheng, Guoan, "Angle-sensitive pixel design for wavefront sensing", 2013 (4 pages).
Rambow, F.H.K et al., "Real-Time Fiber-Optic Casing Imager", SPE Journal, Dec. 2010, pp. 1095-1103 (9 pages).
Kadambi et al., "Rethinking Machine Vision Time of Flight With GHz Heterodyning"; IEEE Access, Massachusetts Institute of Technology, Cambriudge, MA (13 pages).
Köchert et al., "A fully-fibre coupled interferometer system for displacement and angle metrology"; euspen's 16th International Conference & Exhibition, Nottingham, UK, May 2016 (2 pages).
Krishnan et al., "A Micro Tesla Turbine for Power Generation from Lower Pressure Heads and Evaporation Driven Flows"; University of California Berkeley, CA, US (5 pages).

* cited by examiner

DEFORMATION MONITORING MECHANISM WITH MULTI-PIXEL ANGLE-SENSITIVE LASER RANGING

BACKGROUND

Metal loss and deformation of a casing putted into wellbore compromise structural integrity of downhole completions. These issues may arise as results of degradation of material obtained from formation, due to natural and human-made processes; e.g., variations in stress/strain caused by tectonic movements; corrosion and erosion due to oil or gas production; and willful damage by explosive-based perforations and similar stimulation techniques. Typical characterization methods for casing deformation include time lapse caliper logs, flux leakage logs, electromagnetic shift tools, and ultrasonic tools.

In monitoring casing deformation, sometimes there have been uncertainty on locations of electromagnetic sensors, and inaccuracy/blind spots when caliper fingers miss an area with high metal loss. There has been also lack of real-time visualization because data processing and analysis takes between 3 and 5 days. Hence it is vital to provide measurement systems that monitor deformations with accuracy in real-time.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a monitoring device that monitors deformation of a casing installed in a wellbore and housing a production tubing extending from a surface into the wellbore, the monitoring device comprising: a packer that is installed within an annulus between the casing and the production tubing; a deformable substrate that is disposed at an outer side of the annulus and contacts an inner surface of the casing to deform along with deformation of the casing; a light source that is disposed on the deformable substrate and emits light towards an inside of the annulus; an imaging device that is disposed in the packer to be opposite to the light source across the annulus and detects the light emitted from the light source; and a processor that produces a signal from the detected light, processes the produced signal, and transmits the processed signal to a surface control device that monitors the deformation of the casing based on the signal.

In another aspect, embodiments disclosed herein relate to a well system comprising: the monitoring device above; the production tubing that extends from the surface into the wellbore; the casing that is installed in the wellbore and houses the production tubing; and the surface control device that monitors the deformation of the casing based on the signal received from the monitoring device.

In another aspect, embodiments disclosed herein relate to a method of monitoring deformation of a casing installed in a wellbore and housing a production tubing extending from a surface into the wellbore, the method comprising: emitting, by a light source, light towards an inside of an annulus between the casing and the production tubing, wherein the light source is disposed on a deformable substrate that is disposed at an outer side of the annulus and that contacts an inner surface of the casing to deform along with deformation of the casing; detecting, by an imaging device, the light emitted from the light source, wherein the imaging device is disposed in a packer to be opposite to the light source across the annulus, the packer being installed within the annulus; and producing, by a processor, a signal from the detected light, processing the produced signal, and transmitting the processed signal to a surface control device that monitors the deformation of the casing based on the signal.

Other aspects and advantages of the claimed subject matter will be apparent from the following description and the appended claims.

DETAILED DESCRIPTION

Figure 1:
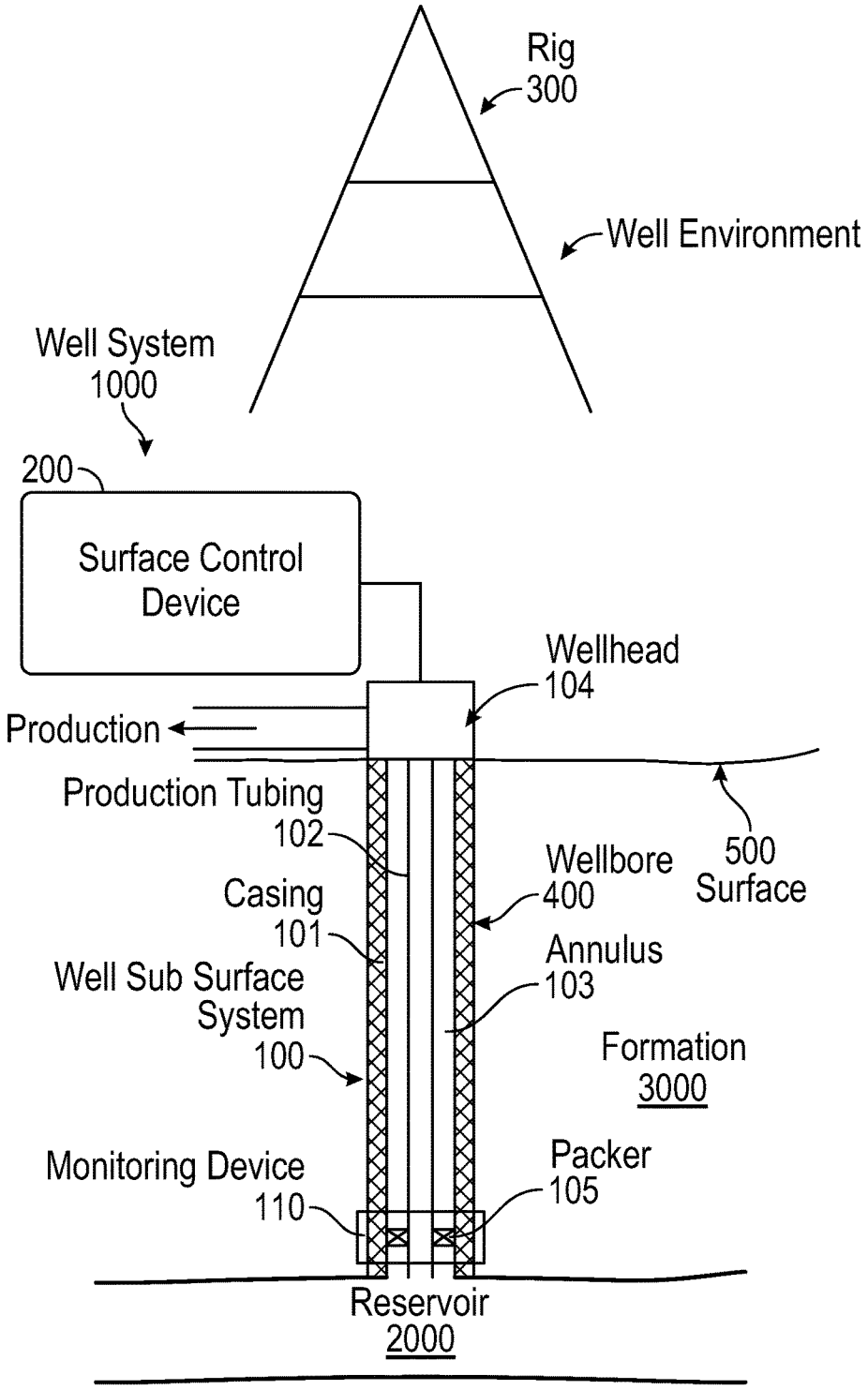
FIG. 1 is a schematic diagram of a well system according to one or more embodiments.

Example devices, systems and methods for monitoring casing deformation are described. Unless explicitly stated otherwise, components and functions are optional and may be combined or subdivided. Similarly, operations may be combined or subdivided, and their sequence may vary.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, or third) may be used as an adjective for an element (that is, any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to an apparatus and method to permanently monitor casing deformations using multi-beam laser ranging. The laser sources are mounted on a deformable substrate, which is contact with the completion. The substrate is designed to locally conform to the deformation of the casing underneath. The laser beams impinge on an array of angle-sensitive CMOS sensors. The measurement considers the beam's incident angle and distance to recreate a point cloud of the deformed substrate.

In one or more embodiments, a well system includes a monitoring device that measures casing deformation and a surface control device that controls the monitoring device. The casing is installed in a wellbore and houses a production tubing extending from a surface into the wellbore. The monitoring device includes a packer that is installed within an annulus between the casing and the production tubing, the deformable substrate that is disposed at an outer side of the annulus and contacts an inner surface of the casing to deform along with deformation of the casing, a light source that is disposed on the deformable substrate and emits light towards an inside of the annulus, an imaging device that is disposed in the packer to be opposite to the light source across the annulus and detects the light emitted from the light source, and a processor that produces a signal from the detected light, processes the produced signal, and transmits the processed signal to the surface control device that monitors the deformation of the casing based on the signal.

The monitoring device enables monitoring casing deformation with accuracy in real-time by using the light source disposed on the deformable substrate and the imaging device disposed opposite to the light source across the annulus. By using the deformable substrate, the casing deformation can be readily and accurately detected.

In one or more embodiments, the casing has a columnar shape, and the deformable substrate is composed of anisotropic material such that deformation of the deformable substrate propagates exclusively along a radial direction of the casing. The deformable substrate may be made of high-temperature elastomer, flexible thermoplastic, or shape memory polymer (SMP). The deformable substrate may also have a thermal expansion of less than 0.01 mm/K and a thermal conductivity of 0.03-0.1 W/mK.

Advantageously, by using the anisotropic deformable substrate, the deformation propagates exclusively along the radial direction and is easily detected with simple light capturing arrangements. Further, by using the high-temperature elastomer, flexible thermoplastic, or SMP, the deformable substrate can flexibly deform along with casing deformation, which enables accurate detection of the casing deformation. Further, by using the deformable substrate having the low thermal expansion and the low thermal conductivity, the casing deformation can be accurately detected even when the casing and the deformable substrate have high temperatures.

In one or more embodiments, the packer has a tube through which a production flows, and the imaging device is disposed on an outer peripheral surface of the tube. By using the packer having such structure, it becomes possible to isolate the imaging device from the wellbore environment and perform accurate measurements.

In one or more embodiments, the light source comprises a laser array including fiber coupled (FC) pulsed lasers, and the imaging device comprises a sensor array that receives the light emitted from the FC pulsed lasers. By using the laser array and the sensor array, it becomes possible to detect the casing deformation without inaccuracy or blind spots.

In one or more embodiments, one laser in the laser array emits a laser beam at a time and all sensors in the sensor array detect an intensity and an incident angle of the laser beam. By adopting one-to-many relationship depending on the pixels angular range of view, the intensity and the incident angle can be detected without inaccuracy or blind spots.

In one or more embodiments, the sensor array includes a charge coupled device (CCD) image sensor or a complementary metal oxide semiconductor (CMOS) image sensor with angle sensitive pixels. By using the angle sensitive pixels, it becomes possible to detect an incident angle of the laser beam and remove the need to isolate deformation along the radial direction.

In one or more embodiments, the processor encodes an arrival time and an incident angle of the light with respect to the sensor array to produce the processed signal. Based on the arrival time and the incident angle, it becomes possible to recreate more accurately the point cloud of the deformed substrate.

FIG. 1 shows a schematic diagram of a well system according to one or more embodiments. FIG. 1 illustrates a well environment that includes a well system 1000, a reservoir 2000, and a formation 3000. In the case of the well system 1000 being operated as a production well, the well system 1000 facilitates the extraction or production (e.g., oil, gas, or both) from the reservoir 2000 located in the formation 3000.

In one or more embodiments, the well system 1000 includes: a well subsurface system 100 including a monitoring device 110, a surface control device 200, a rig 300, and a wellbore 400. The monitoring device 110 monitors casing deformation as described in detail below.

In one or more embodiments, the well subsurface system 100 includes a casing 101 having a columnar shape and installed in the wellbore 400. The casing 101 includes an annular casing that lines the wall of the wellbore 400 to define a passage that provides a conduit for transportation through the wellbore 400. For example, the passage may provide a conduit for lowering logging tools into the wellbore 400, a conduit for the flow of the production from the reservoir 2000 to the surface 500, or a conduit for the flow of injection substances (e.g., water) from the surface 500 into the formation 3000.

Although not illustrated in FIG. 1, the wellbore 400 may have a cased portion and an uncased (or "open-hole") portion. The cased portion may include a portion of the wellbore 400 having the casing 101 disposed therein, and the uncased portion may include a portion of the wellbore 400 not having the casing 101 disposed therein.

In one or more embodiments, the well subsurface system 100 further includes a production tubing 102 installed in the wellbore 400. The production tubing 102 may be disposed inside casing 101. In such embodiments, the production tubing 102 may provide a conduit for some or all of the production passing through the wellbore 400 and the casing 101.

Further, an annulus 103 defined between the casing 101 and the production tubing 102 provides the conduit for transportation through the wellbore 400. The inner, top, and bottom sides of the annulus 103 are made of a low thermal conductivity material, namely, non-metallics (e.g. fiber glass composites). The outer side of the annulus is made of a deformable substrate material, as described below.

In one or more embodiments, the well subsurface system 100 further includes a wellhead 104 at an upper end of the wellbore 400. The wellhead 104 may include structures for supporting (or "hanging") the casing 101 and production tubing 102 extending into the wellbore 400. The production may flow through the wellhead 104, after exiting the wellbore 400 and the well subsurface system 100 including the casing 101 and the production tubing 102.

In one or more embodiments, the well subsurface system 100 further includes one or more packers 105 in the annulus 103. For example, four packers 105 may form a chamber within the casing 101, and the extraction or production may be extracted from a certain part of the formation 300 into the chamber and transported to the surface 500 through the production tubing 102.

Still referring to FIG. 1, the surface control device 200 includes a computer system that is the same as or similar to a computing system 700 described below in FIG. 7, and the accompanying description. The surface control device 200 may also control various operations of the well system 1000, such as well production operations, well completion operations, well maintenance operations, and reservoir monitoring, assessment, and development operations.

During operation of the well system 1000, the surface control device 200 collects and records data from the monitoring device 110. The data may include, for example, a record of measurement values over some or all of the life of the well system 1000. In one or more embodiments, the measurement values are recorded in real-time, and are available for review or use within seconds, minutes, or hours of the condition being sensed (e.g., the measurements are available within one hour of the condition being sensed). In such embodiments, the data may be referred to as "real-time" data. Real-time data may enable an operator of the well system 1000 to assess a relatively current state of the well system 1000, and make real-time decisions regarding development or management of the well system 1000. In some instances, the real-time decisions are performed automatically.

The rig 300 is the machine used to drill a borehole to form the wellbore 400. Major components of the rig 300 include the mud tanks, the mud pumps, the derrick or mast, the draw works, the rotary table or top drive, the Drillstring, the power generation equipment, and auxiliary equipment.

The wellbore 400 includes a bored hole (i.e., borehole) that extends from a surface 500 into a target zone of the formation 3000, such as the reservoir 2000. The wellbore 400 may facilitate the circulation of drilling fluids during drilling operations, the flow of the production from the reservoir 2000 to the surface 500 during production operations, the injection of substances (e.g., water) into the formation 3000 or the reservoir 2000 during injection operations, or the communication of devices such as logging tools into the formation 3000 or the reservoir 2000.

In one or more embodiments, a cable (not shown), such as an electrical or hydraulic power cable, may run down the wellbore 400 and be connected to the monitoring device 110. For example, the monitoring device 110 may be provided power from a power source (not shown) at the surface 500 via the cable. Additionally, the cable may be connected to the surface control device 200 that controls the monitoring device 110.

While FIG. 1 illustrates a configuration of components, other configurations may be used without departing from the scope of the disclosure. For example, various components in FIG. 1 may be combined to create a single component. As another example, the functionality performed by a single component may be performed by two or more components.

The monitoring device 110 monitors deformation of the casing 101 installed in the wellbore 400 underneath the surface 500 by multi-pixel angle-sensitive laser ranging, as explained below. The monitoring device 110 can also indirectly detect deformation of the formation 3000 existing around the casing 101 based on the measurement results of the casing deformation.

Figure 2A:
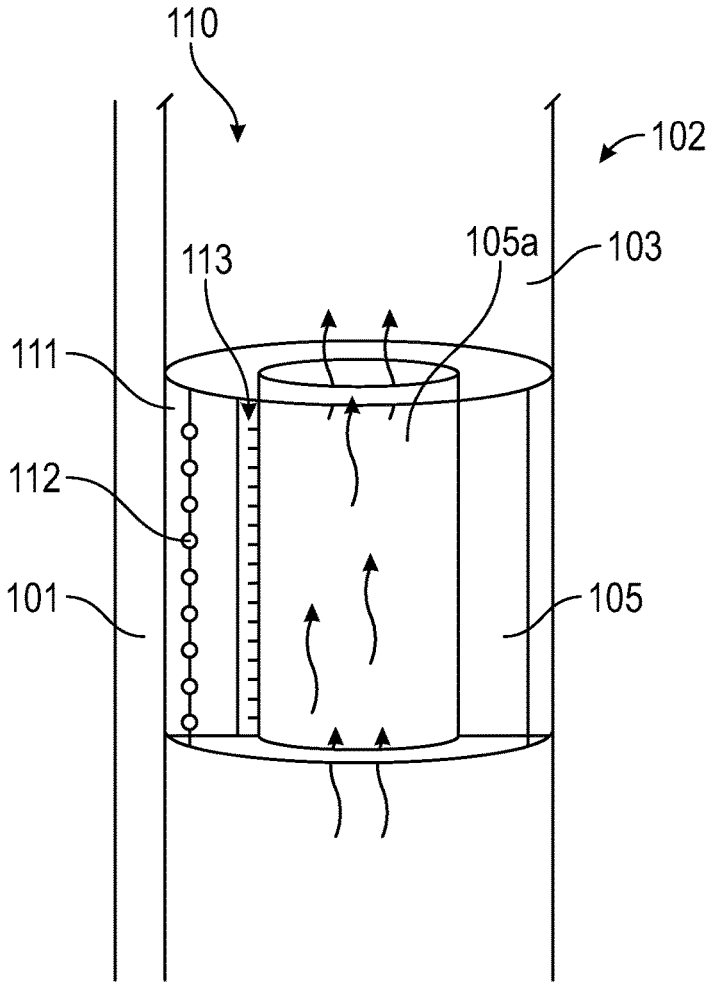
FIG. 2A is a schematic diagram of a monitoring device according to one or more embodiments.
Figure 2B:
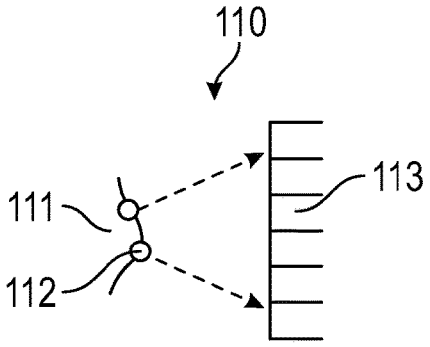
FIG. 2B is a schematic diagram of the monitoring device according to one or more embodiments.
Figures 3A, 3B:
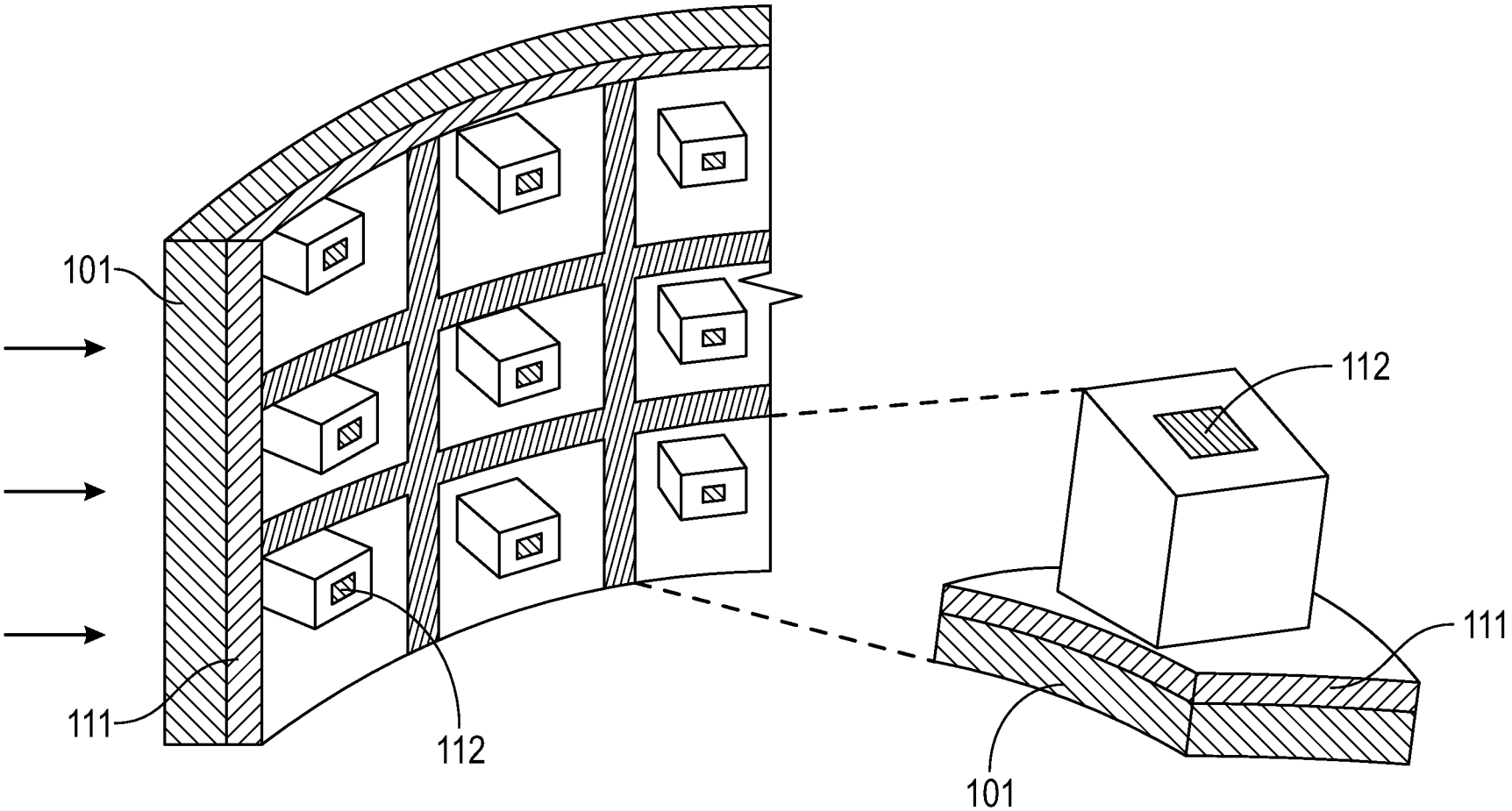
FIG. 3A is a schematic diagram of an imaging device according to one or more embodiments.
FIG. 3B is a schematic diagram of the imaging device according to one or more embodiments.

The monitoring device 110 includes a deformable substrate 111 that is in contact with a completion. The completion refers to an innermost string of the casing 101 or the production tubing 102 such that the deformable substrate 111 deforms conformally to displacements of the underlying surface of the tubing. As illustrated in FIGS. 2A-2B, the deformable substrate 111 is disposed at the outer side of the annulus 103 and directly contacts an inner surface of the casing 101 to deform along with deformation of the casing 101. The monitoring device 110 also includes a light source 112 that is disposed on the deformable substrate 111 and emits light towards an inside of the annulus 103. The deformable substrate 111 may constitute or may be disposed on an outer surface of the packer 105. In one or more embodiments, the packer 105 includes a tube (or a tubular opening) 105*a* that penetrates the packer 105 and through which the production may flow. FIG. 2A shows the flow of the production from the reservoir 2000 to the surface 500 through the tube 105*a*, the flow being indicated with arrows pointing upward. On an outer peripheral surface of the tube 105*a*, an imaging device 113 is disposed to be opposite to the light source 112 across the annulus 103 to detect the light emitted from the light source 112. According to the above configuration, the light source 112 and the imaging device 113 can be isolated from a wellbore environment in the annulus 103 filled with, for example, a high pressure inert gas. Further, the packer 105 remains at a predetermined installation depth for as long as a user desires, making it possible to continuously and permanently monitor the casing deformation.

The light source 112 of one or more embodiments includes laser arrays each of which can be independently modulated, which enables simultaneous measurements within a predetermined range of the casing 101. Alternatively, a laser probe or an M×N (M sources, N outputs) optical switch may be used as the light source 112.

The monitoring device 110 further comprises a processor (e.g., a processing device 120 shown in FIGS. 4-5) that controls the light source 112 and the imaging device 113 via a wired or wireless underground network using cables, wires, fibers, and/or sensors. The processor produces a signal from the light detected by the imaging device 113, processes the signal, and transmits the processed signal to the surface control device 200 that monitors the deformation of the casing 101 based on the obtained real-time data. The monitoring device 110 may also be implemented by a computer system that is the same as or similar to the computing system 700 described below in FIG. 7, and the accompanying description.

In one or more embodiments, the deformable substrate 111 is composed of anisotropic material(s) such that deformation of the deformable substrate 111 propagates exclusively along a radial direction of the casing 101. The anisotropic materials may be composites or plastics with aligned chains in an elastomeric matrix, mechanical metamaterials, embedded with woven reinforcements, as well as anisotropic hydrogels materials with cellular micro/nanostructures or combinations thereof, which are generally known in the art. As a result, the deformation is isolated to propagate exclusively along the radial direction and is more easily detected. This enables more accurate detection of the casing deformation.

In one or more embodiments, a reflectance of the deformable substrate 111 is about 50% or more. Further, the deformable substrate 111 is made of high-temperature elastomers, flexible thermoplastics, or SMPs, with low thermal expansion (<0.01 mm/K) and/or low thermal conductivity (0.03-0.1 W/mK). For example, SMPs can return to their original shape using an electrical signal, which enables quick release (i.e., deforming the deformable material to a state whereby it is no longer in contact with the surface being characterized) for retrieval operations and in-situ recalibration (i.e., returning the deformable material to a known state and conducting a measurement to set a baseline).

On the top of the deformable substrate 111, the light source 112 is disposed and pointing along the radial direction towards the inside of the annulus 103. In one or more embodiments, the light source 112 may comprise a thermoelectric cooling (TEC) that keeps the operating temperature below 80° C. within the wellbore 400, and the laser arrays may be disposed on the TEC. On the opposite side across the annulus 103, the imaging device 113 with the sensor arrays is disposed in the packer 105.

As illustrated in FIGS. 3A through 5, the light source 112 may comprise fiber coupled (FC) pulsed lasers 112A with output couplers (OCs) 112B as the laser arrays. Each OC 112B collimates the laser beam emitted by the FC pulsed lasers 112A. As the laser arrays can cover a wide irradiation range, the casing deformation can be detected without inaccuracy or blind spots.

Returning to FIG. 2A, the sensor arrays of the imaging device 113 are aligned to be a same height as a height of the laser arrays of the light source 112, and receive the laser beam emitted from the FC pulsed lasers 112A. By using such sensor arrays, the laser beams emitted in various directions can be detected by at least one of image sensors of the sensor arrays. This enables more accurate detection of the casing deformation.

In one or more embodiments, the sensor array includes a charge coupled device (CCD) image sensor or a complementary metal oxide semiconductor (CMOS) image sensor with angle sensitive pixels. The angle sensitive pixels can detect an incident angle of the laser beam and removes the need to isolate deformation along the radial direction.

With combination of the anisotropic deformable substrate 111, the light source 112 with the laser arrays, and the imaging device 113 with the angle sensitive image sensors disposed in the packer 105, the monitoring device 110 attains real-time and permanent monitoring of casing deformation with simple light capturing arrangements.

The distribution of the laser arrays can vary along an azimuth angle and height of the lasers. The minimum for operation is four lasers positioned at a predetermined height and distributed with 90 degrees separation along the azimuthal coordinate.

The followings are examples of positional relationships between the lasers and the image sensors:

1. One-to-one relationship: one laser in the laser array emits and one sensor located directly in front (radially opposed and at the same height) detects the intensity of the laser beam;

2. One-to-many relationship: one laser in the laser array emits at a time and all sensors located in front (radially opposed but along all height levels) detect the intensity and the incident angle of the laser beam; and 3. Many-to-many relationship: all lasers in the laser array emit simultaneously and all sensors detect the intensity and the incident angle. In this case, every laser either has a distinct frequency or modulation to distinguish their provenance. However, this detection may lead to overlap and churning.

The angle sensitive image sensor can be posited to use the angle-sensitive pixel design, which is well known in photonics engineering. In one or more embodiments, depending on the pixels angular range of view (typically +/−20 degrees), one-to-many relationship may be adopted.

The arrival time detected by the image sensor in combination with a trigger described later provide a measurement of time interval between signals. This enables a computation of a time of flight, which can be used to derive a distance between a top of each laser and each pixel of the image sensor. The angle sensitive image sensor enables an additional measurement of the incident angle of the laser beam, which can be used to calculate the casing deformation with higher accuracy. This setup is particularly useful in the one-to-many and many-to-many positional relationships between the lasers and the image sensors. The processor encodes the incident angle and the arrival time of the laser beam, produces the processed signal, and transmits the processed signal to the surface control device 200 that monitors the casing deformation based on the processed signal.

The surface control device 200 may perform measurements considering the incident angle and the distance, and recreates a point cloud of the deformed substrate 111, in real-time.

Figure 4:
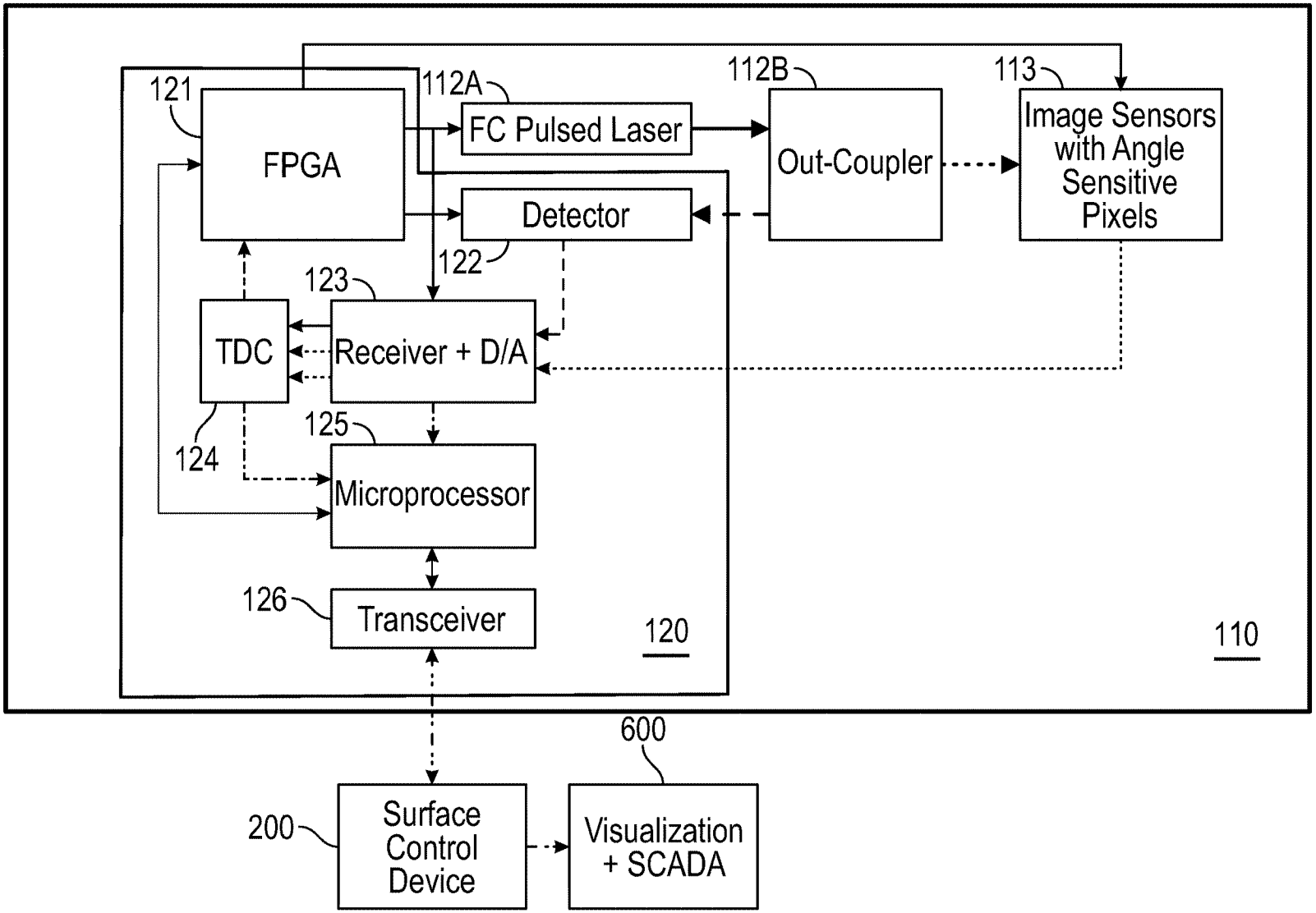
FIG. 4 is a block diagram of the monitoring device according to one or more embodiments.
Figure 5:
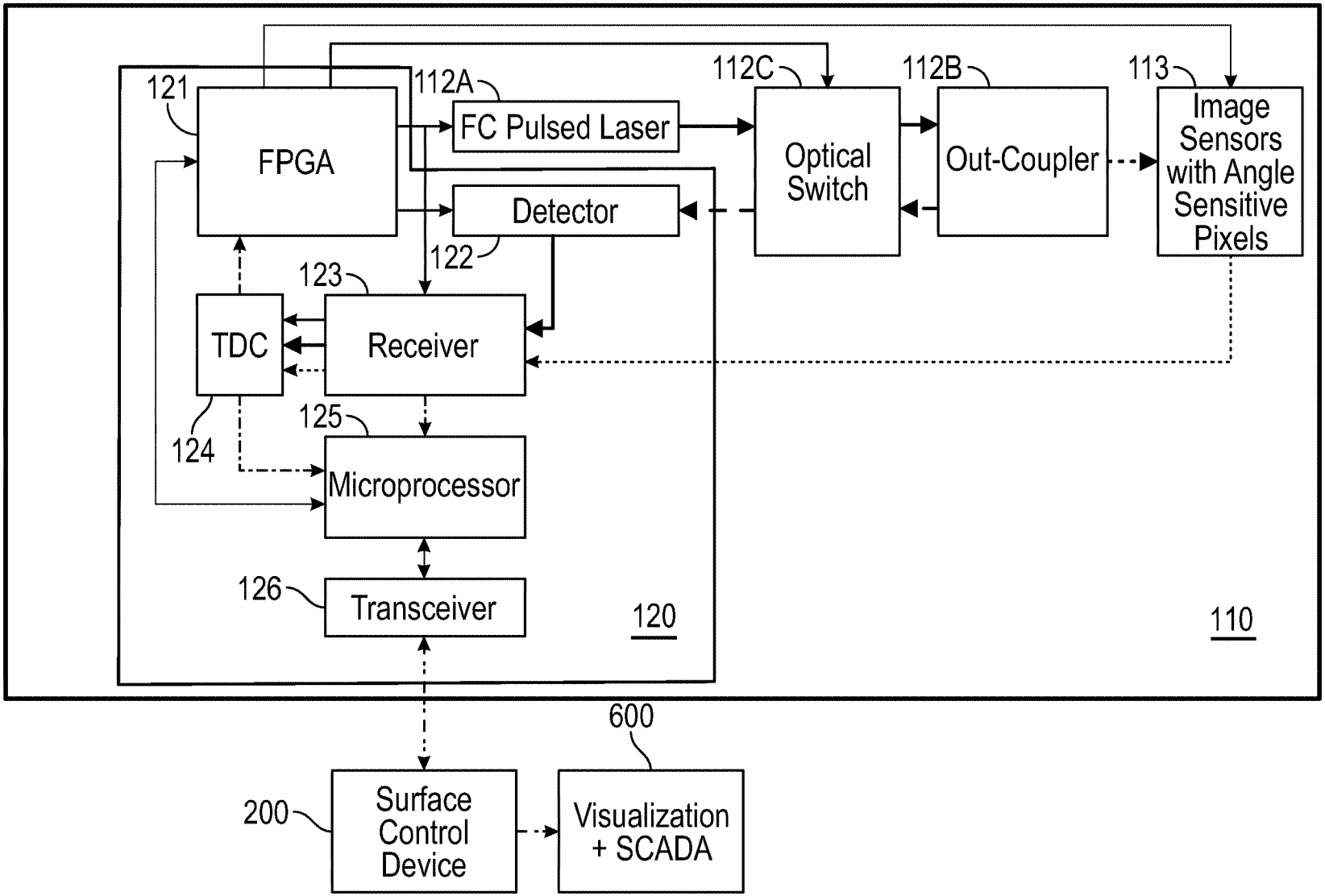
FIG. 5 is a block diagram of the monitoring device according to one or more embodiments.

FIGS. 4-5 show block diagrams of the monitoring device 110 according to one or more embodiments. The light source 112 may be either a single source type using a separate laser per each measurement probe, or a shared source type using a single laser unit and an 1×N optical switch. FIG. 4 is the block diagram of the monitoring device 110 adopting the single source type light source 112, and FIG. 5 is the block diagram of the monitoring device 110 adopting the shared source type light source 112.

As shown in FIG. 4, the monitoring device 110 includes the processing device 120. The processing device 120 includes a field programmable gate array (FPGA) 121. detector 122, receiver 123, time digital converter (TDC) 124, microprocessor 125, and transceiver 126. The entire system (FPGA, TDC, Receiver, microprocessor, and transceiver) are all parts of the subsurface computing box. The monitoring device 110 may further include the pulsed lasers 112A, the OCs 112B, and the imaging device 113 with angle sensitive image sensors. FIG. 4 also shows the surface control device 200 and a supervisory control and data acquisition system (SCADA) 600. In one or more embodiments, the SCADA system 600 comprises: an input tool (e.g., sensors); a monitoring/controlling tool (e.g., programmable logic controller (PLC)); an information displaying/managing tool (e.g., graphical user interface (GUI)); and a communicating tool (e.g., serial devices), and that collectively monitors and controls a plurality of well systems including the well system 1000.

The FPGA 121 controls, upon receiving an instruction signal or trigger from the surface control device 200 or the microprocessor 125, the pulsed lasers 112A to switch on/off of the laser beam. Each pulsed laser 112A emits the laser beam via the OC 112B towards the inside of the annulus 113. The imaging device 113 with the angle sensitive image sensors detects the incident position, incident time, and incident angle of the laser beam, and sends the same to the detector 122. The FPGA 121 is isolated to control the pulsed lasers 112A exclusively; thus providing a layer of redundancy and offloading operations from the microprocessor 125.

The detector 122 comprises a photodiode that converts the detected light into electrical signals, and an amplifier that amplifies the electrical signals. The receiver 123 comprises an analog/digital. (A/D) converter(s), which encode the electrical signals each indicating a pulse amplitude and the incident angle of the laser beam entering each pixel.

The TDC 124 measures time intervals between signals received from the receiver 123 and converts measurement results into digital signals. Upon receiving the digital signals from the TDC 124, the microprocessor 125, which is a subsurface computing unit, calculates a time difference between the digital signals and sends a reset trigger to the FGPA 121 upon occurrence of a max set interval. In the case of adopting the many-to-many relationship described above, in addition to each out-coupler 112B, an acousto-optic amplitude modulator can be used to distinguish output signals from one another.

Upon receiving the processed signals from the receiver 123, the microprocessor 125 causes the transceiver 126 to send the processed signal to the surface control device 200, as either an acoustic signal via an electric-acoustic transducer or via an optical fiber installed in the packer 105.

The SCADA system 600 may visualize the casing deformation by creating two-dimensional and/or three-dimensional images of the casing 101 based on the point cloud of the deformed substrate 111 such that a user can effectively monitor the casing deformations with accuracy in real-time. For example, the visualization can be carried out with any open-source package that is able to display 3D point clouds and slices (e.g., YT, VTKPlotter, Open3D, Matplotlib, PPTK, among others). The SCADA system 600 may provide a dataset of points in cylindrical coordinates ($r_i^t$, $\theta_i$, $z_i$); where $r_i^t$ is a radial distance between an i-th sensor and each light source 112 at given time (t). The distance can be calculated as a delta with a calibrated system at initial time (t=0): ($r_i^0$, $\theta_i$, $z_i$i), or with reference to a previous time. The former being the absolute displacement, and the latter the relative displacement. The point cloud can be automatically processed to characterize displacement velocities or detect abnormalities. The latter can be by comparing the distance to a given threshold. Alternatively, if sufficient data is available then it is possible to characterize the abnormal behavior from studying the distribution of known.

Alternatively, the surface control device 200 may perform such visualization. In this case, the SCADA system 600 may monitor the case deformation based on the images of the casing 101 transmitted from the surface control device 200, and when detecting abnormality, inform a user of the abnormality, for example, by issuing a warning.

FIG. 5 depicts the functional configuration similar to that of FIG. 4 but different in that the optical switch 112C is provided between the FC pulsed laser 112A and the out-coupler 112B. The optical switch 112C may use a 1×2 90/10 beam splitter, with the end of the 10%-transmission-arm ending in a mirror, or a partially reflective window (90/10) to return a portion (<10%) of the input beam (signal) to detector 122.

In one or more embodiments, energy can be provided to the well system 1000 by directly harvesting the energy from the flow; for example, using Tesla microturbines, as generally known in the art. Alternatively, the energy can be harvested from pressure gradients in the flow along the packers 105 using thermoelectric materials specially designed for low-thermal gradients and high-pressure. The energy can also be provided via the cables, through the optical fiber, or by downhole batteries. If the energy is provided through an optical fiber link, then in addition to the transceiver 126, the well system 1000 can include a 1×2 90/10 beam splitter and a photocell at the end of the 90%-transmission-arm. The bandgap of photocell can be designed to harvest the maximum power from the incoming signal.

Figure 6:
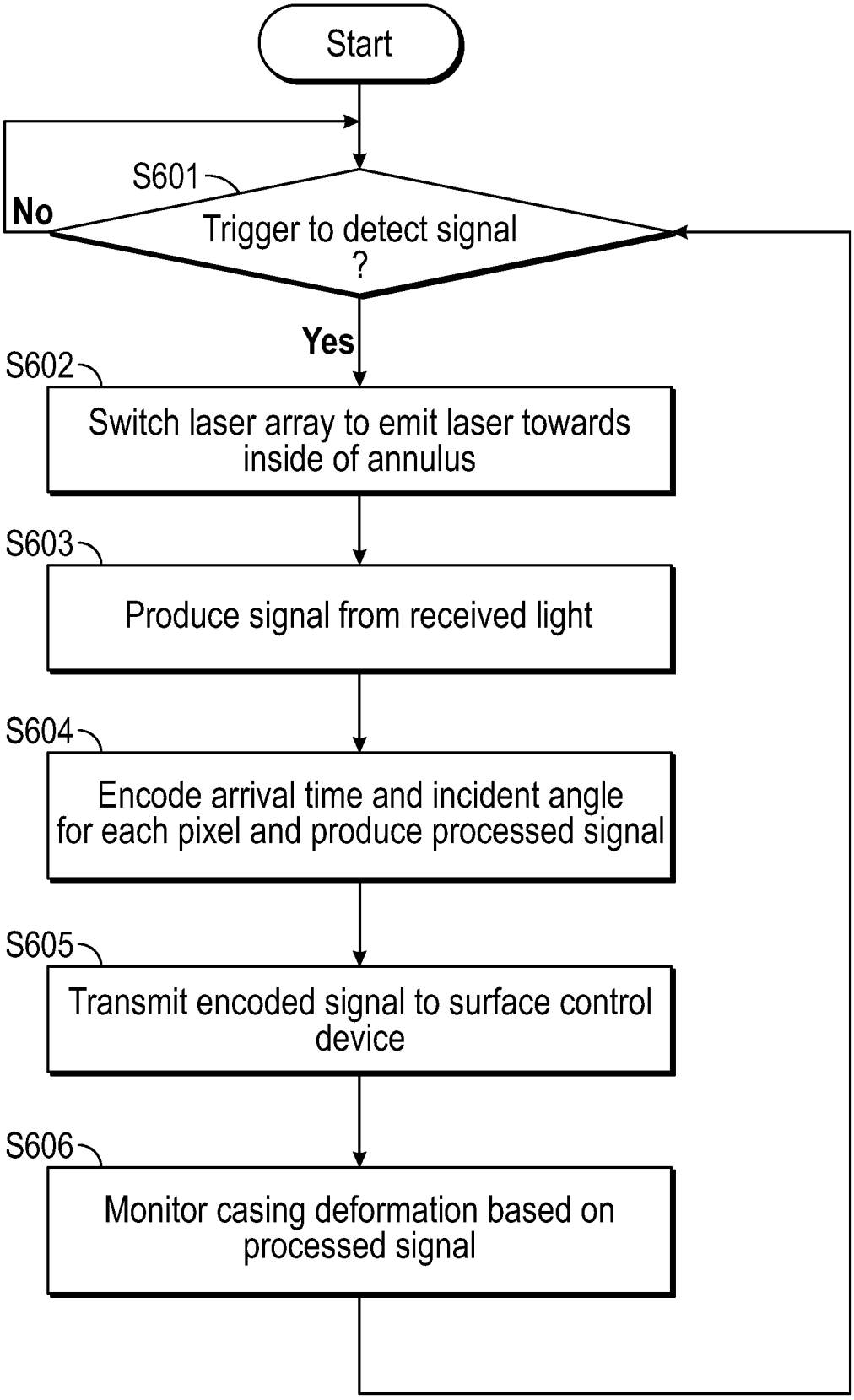
FIG. 6 is a flowchart of a monitoring method according to one or more embodiments.

FIG. 6 is a flowchart of a monitoring method according to one or more embodiments. One or more blocks in FIG. 6 may be performed by one or more components of the well system 1000. For example, a non-transitory computer readable medium may store instructions on a memory coupled to a processor such that the instructions include functionality for operating the well system 1000. Such a computer system with a processor and memory is shown in FIG. 7 below. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

First, the FPGA 121 of the monitoring device 110 determines whether a trigger to start monitoring of the casing deformation has been received from the surface control device 200 or the microprocessor 125 of the monitoring device 110 (Step S601). When determining that the trigger has not been received (Step S601: No), the FPGA 121 continues to determine whether the trigger has been received (Step S601).

When determining that the trigger has been received (Step S601: Yes), the FPGA 121 controls the light source 112 to switch the FC pulsed laser 112A to emit the laser beam and the imaging device 113 detects the emitted light (Step S602).

Upon receiving the detected light from the imaging device 113, the detector 122 converts the detected light into electrical signals and amplifies the same (Step S603).

Upon receiving electrical signals from the detector 122, the receiver 123 encodes the electrical signals each indicating the pulse amplitude and the incident angle (Step S604).

After that, the transceiver 126 sends the encoded signals to the surface control device 200 (Step S605).

Upon receiving the encoded signals from the transceiver 126, the surface control device 200 decodes the encoded signals and recreates the point cloud of the deformed substrate 111. Based on the point cloud of the deformed substrate 111, the surface control device 200 measures the casing deformation continuously or at a predetermined time period, in real-time (Step S606).

The surface control device 200 and/or the SCADA system 600 can utilize the measurement results of the casing deformation in various ways. For example, based on the measurement results, the surface control device 200 can send the electrical signal to the deformable substrate 111 made of SMP such that the deformable substrate 111 returns to have its original shape. Any other means can he adopted to fix the casing deformation. For example, the deformation time-lapse data could be fed to algorithms like Althus to predict structural issues with the completion/wellbore integrity because the deformation results from the interplay of the forces acting on the casing 101. Moreover, the time-lapse data can characterize effects of stimulation techniques on the casing 101, for example, in order to prevent the casing 101 from deforming in a manner that can lead to degradation of integrity during perforation and fracking. Furthermore, because the time-lapse data could also acquire minor vibrations (mm-wise), the time-lapse data can be fed to virtual flow meters and used in the prediction of multiphase flows.

Implementations herein for operating the well system 1000 may be implemented on a computing system coupled to a controller in communication with the various components of the well system 1000. Any combination of mobile, desktop, server, router, switch, embedded device, or other types of hardware may be used with the well system 1000. For example, as shown in FIG. 7, the computing system 700 may include one or more computer processors 702, non-persistent storage 704 (e.g., volatile memory, such as random access memory (RAM), cache memory), persistent storage 706 (e.g., a hard disk, an optical drive such as a compact disk (CD) drive or digital versatile disk (DVD) drive, a flash memory, etc.), communication interface 712 (e.g., Bluetooth interface, infrared interface, network interface, optical interface, etc.), and numerous other elements and functionalities. It is further envisioned that software instructions in a form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. For example, the software instructions may correspond to computer readable program code that, when executed by a processor(s), is configured to perform one or more embodiments of the disclosure.

The computing system 700 may also include one or more input devices 710, such as a touchscreen, keyboard, mouse, microphone, touchpad, electronic pen, or any other type of input device. Additionally, the computing system 700 may include one or more output devices 708, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 702, non-persistent storage 704, and persistent storage 706. Many different types of computing systems exist, and the input and output device(s) may take other forms.

Figure 7:
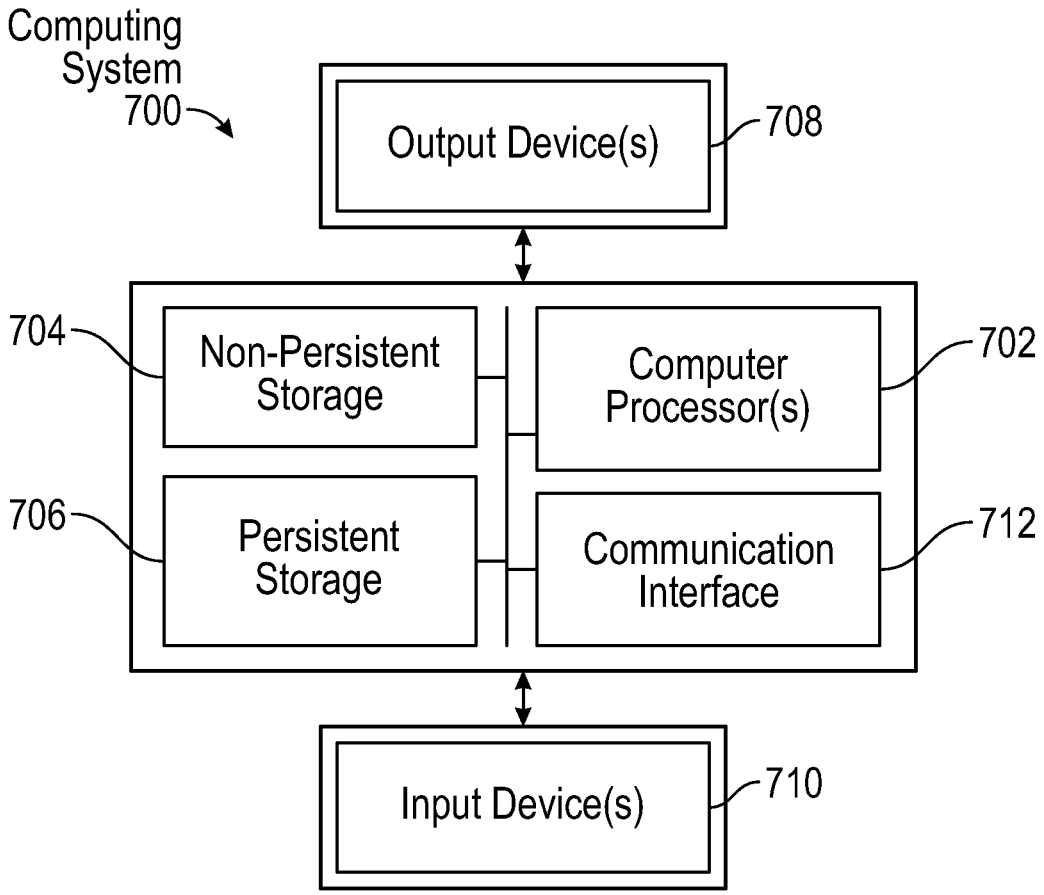
FIG. 7 is a schematic diagram of a computing system according to one or more embodiments.

The computing system 700 of FIG. 7 may include functionality to present raw and/or processed data, such as results of comparisons and other processing. For example, presenting data may be accomplished through various presenting methods. Specifically, data may be presented through a user interface provided by a computing device. The user interface may include a graphical user interface (GUI) that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model. For example, a GUI may first obtain a notification from a software application requesting that a particular data object be presented within the GUI. Next, the GUI may determine a data object type associated with the data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the data object and render a visual representation of the data values within a display device according to the designated rules for that data object type.

Data may also be presented through various audio methods. Data may be rendered into an audio format and presented as sound through one or more speakers operably connected to a computing device. Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The well system 1000 of one or more embodiments provide various improvements to deformation monitoring technologies. For example, the monitoring device enables monitoring the casing deformation with accuracy in real-time by using the light source disposed on the deformable substrate and the imaging device disposed opposite to the light source across the annulus. By using the deformable substrate, the casing deformation can be readily and accurately detected.

Especially, by using the anisotropic deformable substrate, the deformation propagates exclusively along the radial direction and is more easily detected, which enables accurately detecting the casing deformation with simple light capturing arrangements. Further, by using the high-temperature elastomer, flexible thermoplastic, or SMP, the deformable substrate can flexibly deform along with casing deformation, which enables accurate detection of the casing deformation. Further, by using the deformable substrate having the low thermal expansion and the low thermal conductivity, the casing deformation can be accurately detected even when the casing and the deformable substrate have high temperatures.

Moreover, by using the packer in which the imaging device is disposed, it becomes possible to isolate the imaging device from the wellbore environment and perform accurate measurements.

Furthermore, by using the laser array and the sensor array, it becomes possible to detect the casing deformation without inaccuracy or blind spot.

Moreover, one-to-many relationship may be adopted depending on the pixels angular range of view and thereby the intensity and the incident angle can be detected without inaccuracy or blind spots.

Furthermore, by using the angle sensitive pixels, it becomes possible to detect the incident angle of the laser beam and remove the need to isolate deformation along the radial direction.

Moreover, based on the arrival time and the incident angle, it becomes possible to recreate more accurately the point cloud of the deformed substrate.

While the method and apparatus have been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed:

1. A monitoring device that monitors deformation of a casing installed in a wellbore and housing a production tubing extending from a surface into the wellbore, the monitoring device comprising:

a packer that is installed within an annulus between the casing and the production tubing;

a deformable substrate that is disposed at an outer side of the annulus and contacts an inner surface of the casing to deform along with the deformation of the casing;

a light source that is disposed on the deformable substrate and emits light towards an inside of the annulus;

an imaging device that is disposed in the packer to be opposite to the light source across the annulus and detects the light emitted from the light source; and a processor that produces a signal from the detected light, processes the produced signal, and transmits the processed signal to a surface control device that monitors the deformation of the casing based on the signal.

2. The monitoring device according to claim 1, wherein the casing has a columnar shape, and the deformable substrate is composed of anisotropic material such that the deformation of the deformable substrate propagates exclusively along a radial direction of the casing.

3. The monitoring device according to claim 1, wherein the deformable substrate is made of high-temperature elastomer, flexible thermoplastic, or shape memory polymer (SMP).

4. The monitoring device according to claim 1, wherein the deformable substrate has a thermal expansion of less than 0.01 (millimeter/kelvin) and a thermal conductivity of 0.03-0.1 (watts/(meter*kelvin)).

5. The monitoring device according to claim 1, wherein the packer includes a tube that penetrates the packer and through which a production flows, and the imaging device is disposed on an outer peripheral surface of the tube.

6. The monitoring device according to claim 1, wherein the light source comprises a laser array including fiber coupled (FC) pulsed lasers, and the imaging device comprises a sensor array that receives the light emitted from the FC pulsed lasers.

7. The monitoring device according to claim 6, wherein one laser in the laser array emits a laser beam at a time and all sensors in the sensor array detect an intensity and an incident angle of the laser beam.

8. The monitoring device according to claim 6, wherein the sensor array includes a charge coupled device (CCD) image sensor or a complementary metal oxide semiconductor (CMOS) image sensor with angle sensitive pixels.

9. The monitoring device according to claim 8, wherein the processor encodes an arrival time and an incident angle of the light with respect to the sensor array to produce the processed signal.

10. A well system, comprising:

the monitoring device according to claim 1;

the production tubing that extends from the surface into the wellbore;

the casing that is installed in the wellbore and houses the production tubing; and the surface control device that monitors the deformation of the casing based on the signal received from the monitoring device.

11. A method of monitoring deformation of a casing installed in a wellbore and housing a production tubing extending from a surface into the wellbore, the method comprising:

emitting, by a light source, light towards an inside of an annulus between the casing and the production tubing, wherein the light source is disposed on a deformable substrate that is disposed at an outer side of the annulus and that contacts an inner surface of the casing to deform along with the deformation of the casing;

detecting, by an imaging device, the light emitted from the light source, wherein the imaging device is disposed in a packer to be opposite to the light source across the annulus, the packer being installed within the annulus; and producing, by a processor, a signal from the detected light, processing the produced signal, and transmitting the processed signal to a surface control device that monitors the deformation of the casing based on the signal.

12. The method according to claim 11, wherein the casing has a columnar shape, and the deformable substrate is composed of anisotropic material such that the deformation of the deformable substrate propagates exclusively along a radial direction of the casing.

13. The method according to claim 11, wherein the deformable substrate is made of high-temperature elastomer, flexible thermoplastic, or shape memory polymer (SMP).

14. The method according to claim 11, wherein the deformable substrate has a thermal expansion of less than 0.01 (millimeter/kelvin) and a thermal conductivity of 0.03-0.1 (watts/(meter*kelvin)).

15. The method according to claim 11, wherein the packer includes a tube that penetrates the packer and through which a production flows, and the imaging device is disposed on an outer peripheral surface of the tube.

16. The method according to claim 11, wherein the light source comprises a laser array including fiber coupled (FC) pulsed lasers, and the imaging device comprises a sensor array that receives the light emitted from the FC pulsed lasers.

17. The method according to claim 16, wherein the emitting includes:

emitting a laser beam from one laser in the laser array at a time, and the detecting includes:

detecting an intensity and an incident angle of the laser beam by all sensors in the sensor array.

18. The method according to claim 16, wherein the sensor array includes a charge coupled device (CCD) image sensor or a complementary metal oxide semiconductor (CMOS) image sensor with angle sensitive pixels.

19. The method according to claim 18, further comprising: encoding an arrival time and an incident angle of the light with respect to the sensor array to produce the processed signal.

* * * * *